US009592948B2

(12) United States Patent
Messner

(10) Patent No.: US 9,592,948 B2
(45) Date of Patent: Mar. 14, 2017

(54) DISPENSER STIR STICK

(71) Applicant: MerchSource, LLC, Foothill Ranch, CA (US)

(72) Inventor: Barry Messner, Anaheim Hills, CA (US)

(73) Assignee: MerchSource, LLC, Irvine, CA (US)

( * ) Notice: Subject to any disclaimer, the term of this patent is extended or adjusted under 35 U.S.C. 154(b) by 622 days.

(21) Appl. No.: 13/573,805

(22) Filed: Oct. 3, 2012

(65) Prior Publication Data

US 2013/0105510 A1 May 2, 2013

Related U.S. Application Data

(60) Provisional application No. 61/542,653, filed on Oct. 3, 2011.

(51) Int. Cl.

| | |
|---|---|
| ***G07F 11/00*** | (2006.01) |
| ***B65H 3/60*** | (2006.01) |
| ***B65D 83/04*** | (2006.01) |
| ***G07F 11/16*** | (2006.01) |

(52) U.S. Cl.
CPC ..... *B65D 83/04* (2013.01); *G07F 11/16* (2013.01)

(58) Field of Classification Search
CPC ..... B65D 83/04; G07F 11/16
USPC ..... 221/1, 92, 288, 203
See application file for complete search history.

(56) References Cited

U.S. PATENT DOCUMENTS

| | | | | | |
|---|---|---|---|---|---|
| 1,753,716 | A * | 4/1930 | Owen | B28C 5/1292 | 366/38 |
| 3,618,733 | A * | 11/1971 | Winsett | G07F 17/0071 | 194/242 |
| 3,659,827 | A * | 5/1972 | Fogt | F25C 5/18 | 366/144 |
| 4,810,230 | A * | 3/1989 | Shirasawa | G07D 9/008 | 221/203 |
| 4,942,979 | A * | 7/1990 | Linstromberg | F25C 5/005 | 221/75 |
| 5,176,290 | A * | 1/1993 | Schwarzli | G07F 11/44 | 221/200 |

(Continued)

*Primary Examiner* — Rakesh Kumar
(74) *Attorney, Agent, or Firm* — Avyno Law P.C.

(57) ABSTRACT

A dispenser is provided that includes a base and a container. The container is positioned above the base for holding articles to dispensed, such as candy. The base includes a channel in communication with the container to dispense the articles. The channel has, near a first end, an internal opening for receiving the articles held in the container and an external opening near the opposing end for dispensing the articles. An advancement mechanism, such as an auger, for example, is located within the channel for moving the articles from the internal opening of the channel to the external opening of the channel. At least one gear, driven by a motor, is connected to the advancement mechanism for moving the advancement mechanism in response to the activation of the motor. A stir stick is attached to at least one side of the at least one gear and extends upward from the base and into the container at a position adjacent the internal opening of the channel. As the gear moves upon activation of the motor, the stir stick also moves to stir the articles in the container as they enter the internal opening. In one example, the motor may be motion activated and run for only a certain predetermined period of time to dispense the articles.

4 Claims, 3 Drawing Sheets

(56) References Cited

U.S. PATENT DOCUMENTS 5,191,998 A * 3/1993 Schwarzli ..... G07F 11/44 221/203
5,244,076 A * 9/1993 Bachmann ..... B65D 88/68 198/443
5,280,845 A * 1/1994 Leight ..... G07F 11/44 221/1
5,480,061 A * 1/1996 Ellinger ..... G07F 11/24 198/548
6,123,445 A * 9/2000 Grassi ..... B01F 7/00708 366/157.2
6,536,623 B1 * 3/2003 Sutcliffe ..... G07F 11/44 221/24
6,666,573 B2 * 12/2003 Grassi ..... B01F 5/0473 366/150.1
6,729,753 B2 * 5/2004 Artman ..... A47J 31/401 366/131
7,017,780 B2 * 3/2006 Renaud ..... B65D 83/0409 221/263
7,440,705 B2 * 10/2008 Hatakeyama ..... G03G 15/0856 399/12
7,556,176 B2 * 7/2009 Yao ..... G07F 11/007 221/155
7,980,419 B2 * 7/2011 Young ..... B65B 7/2835 221/13
7,992,748 B2 * 8/2011 Lawrence ..... G07F 11/54 221/203
8,915,406 B2 * 12/2014 Hu ..... A47J 31/404 222/1
2003/0218025 A1 * 11/2003 Hawkes ..... F25C 5/007 222/146.6
2004/0173637 A1 * 9/2004 Whippie ..... G01F 13/005 222/236
2006/0000846 A1 * 1/2006 Schwarzli ..... G07F 11/44 221/196
2006/0157498 A1 * 7/2006 Yao ..... G07F 11/44 221/200
2006/0249531 A1 * 11/2006 Litchfield ..... G07F 11/44 222/52

* cited by examiner

DISPENSER STIR STICK

RELATED APPLICATIONS

This application claims priority of U.S. Application Ser. No. 61/542,653, filed on Oct. 3, 2011, titled DISPENSER STIR STICK, which application is incorporated in its entirety by reference in this application.

BACKGROUND OF THE INVENTION

1. Field of the Invention

A dispenser is provided for dispensing articles such as candy or other consumables. In particular, the dispenser of the invention includes a dispensing mechanism having a stir stick for stirring the candy upon dispensing to help prevent the candy from getting jammed in the dispensing mechanism.

2. Related Art

Food dispensers are well known in the art. It has been a long standing problem with any type of dispensing mechanism that the articles being dispensed get jammed upon entry into or within the channel in which the articles are dispensed. A need continues to exist for a dispensing mechanism for use in connection with a candy or food dispenser that prevents the articles from jamming upon entry or within the dispensing mechanism.

SUMMARY

A dispenser is provided that includes a base and a container. The container is positioned above the base for holding articles to dispensed, such as candy. The base includes a channel in communication with the container that retains the articles to be dispensed. The channel has, near a first end, an internal opening for receiving the articles held in the container and an external opening near the opposing end for dispensing the articles. An advancement mechanism, such as an auger, for example, is located within the channel for moving the articles from the internal opening of the channel to the external opening of the channel. At least one gear, driven by a motor, is connected to the advancement mechanism for moving the advancement mechanism in response to the activation of the motor. A stir stick is attached to at least one side of the at least one gear and extends upward from the base and into the container at a position adjacent the internal opening of the channel. As the gear moves upon activation of the motor, the stir stick also moves to stir the articles in the container as they enter the internal opening of the channel. In one example, the motor may be motion activated and run for only a certain predetermined period of time to dispense the articles.

Other devices, apparatus, systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE FIGURES

The invention may be better understood by referring to the following figures. The components in the figures are not necessarily to scale, emphasis instead being placed upon illustrating the principles of the invention. In the figures, like reference numerals designate corresponding parts throughout the different views.

DETAILED DESCRIPTION

Figure 1:
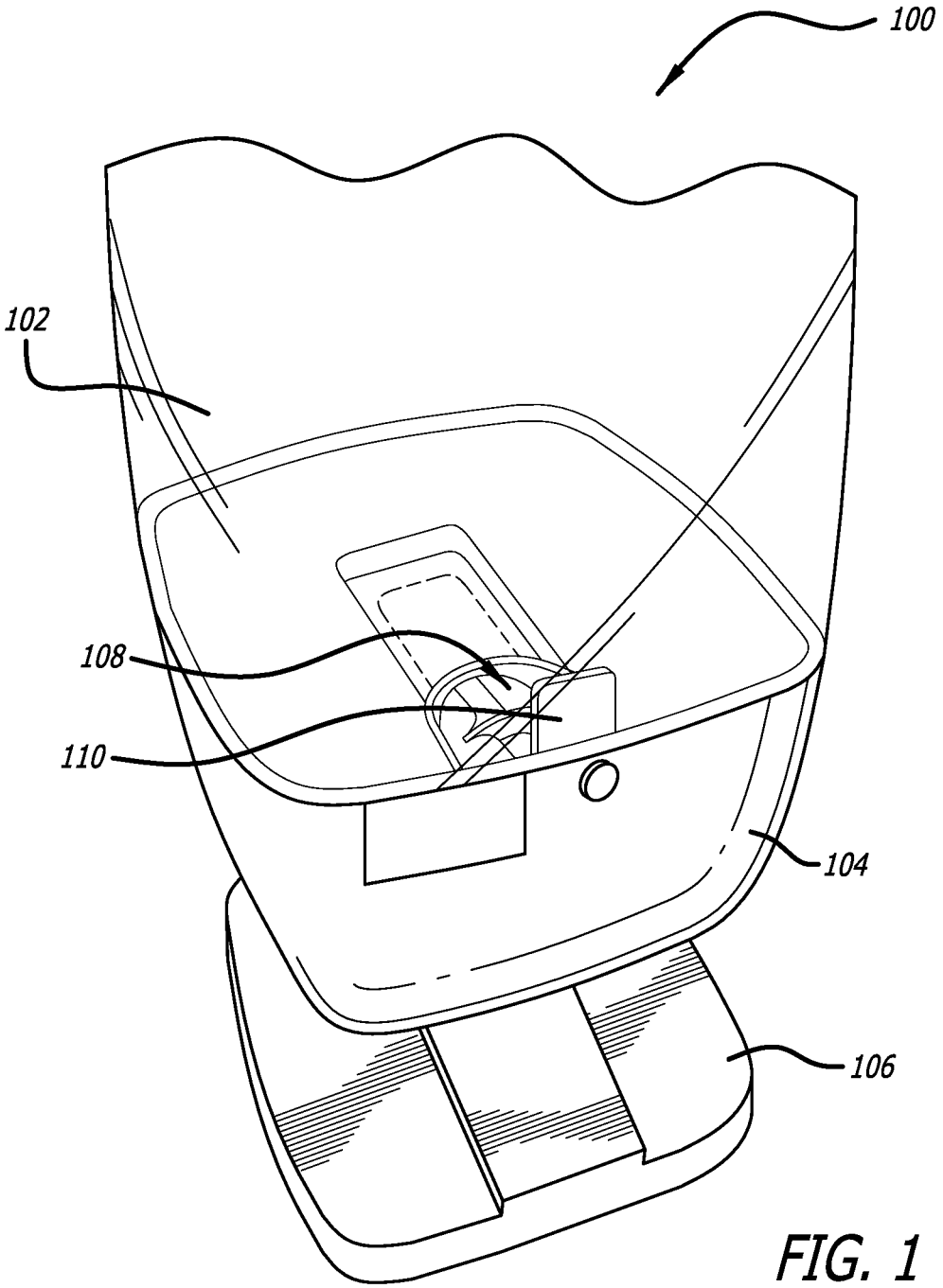
FIG. 1 illustrates one example of a candy dispenser having a dispensing mechanism of the present invention which includes a stir stick.

FIG. 1 illustrates one example of a candy dispenser 100 having a dispensing mechanism of the present invention. As illustrated in FIG. 1, a candy dispenser 100 is provided that includes a housing/container 102 and a base 104. The container 102 is positioned above the base 104 and, as illustrated in FIG. 1, is a clear transparent container 102 for viewing of the articles to be held within the container 102. The base 104 is positioned below the container 102 and includes a dispensing mechanism 108 for transporting the articles from within the container 102 to a user. The base 104 is provided in this illustrated example with a support 106 that supports both the housing 102 and the base 104 on a flat surface.

In one example of the invention, the dispensing mechanism 108 is formed as a channel 116 within the base 104. The channel 116 includes at one end an internal opening 118 that communicates with the internal portion of the container 102 for receiving the articles from the container 102. At an opposing end, the channel 116 includes an exterior opening (not shown) that exists to the surroundings of the base 104. Within the channel 116 is an advancement mechanism or auger 114 for moving the articles from the internal opening of the channel to the external opening of the channel. The advancement mechanism 114 is connected at one end to a gear 112 that moves the advancement mechanism 114. The gear 112 is controlled by a motor (not shown) located in the base 104 of the dispenser 100. The gear 112 is moved in response to the activation of a motor, which may activated by powering the motor on/off through a switch or through motion activation or other means supplying power to the motor via a switch.

As further seen in FIG. 1, a stir stick 110 is provided that extends upward into the container 102 adjacent to the internal opening 118 of the channel 116 to contact the articles in the container 102. The stir stick 110 is engaged at one side of the gear 112 and thus, as the gear 112 is put in motion, the stir stick 110 also moves with the gear 112, causing the stir stick 112 to move in a rotating manner. As the stir stick 110 moves in a rotating manner, it moves up and down and side-to-side in contact with the articles, thereby stirring the articles as they move into the interior opening 118 of the channel 116. The stirring promotes the articles to enter the interior opening 118 of the channel 116 without jamming.

Figure 2:
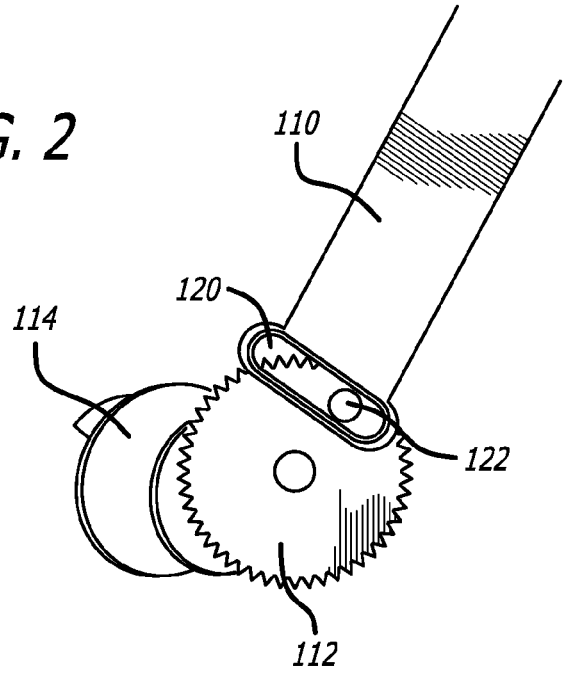
FIG. 2 illustrates one example of a dispensing mechanism for use in connection with the present invention.

FIG. 2 illustrates one example of a dispensing mechanism 108 for use in connection with the present invention. FIG. 2 illustrates the advancement mechanism 114 affixed to a gear 112 that includes the stir stick 110 attached to at least one side of the gear 112. In the illustrated example, the advancement mechanism 114 is an auger having a gear 112 attached at one end. The stir stick 110 includes an opening 120 for receiving a post 122 extending perpendicular to one side of the gear 112. Those skilled in the art will recognize that as the gear 112 rotates, the stir stick 110 will also move in a rotating fashion, and will further recognize that other known mechanisms for attaching the stir stick 110 to the gear 112 may be utilized, including but not limited to adhesive, fasteners or other friction fit arrangements.

Figure 3:
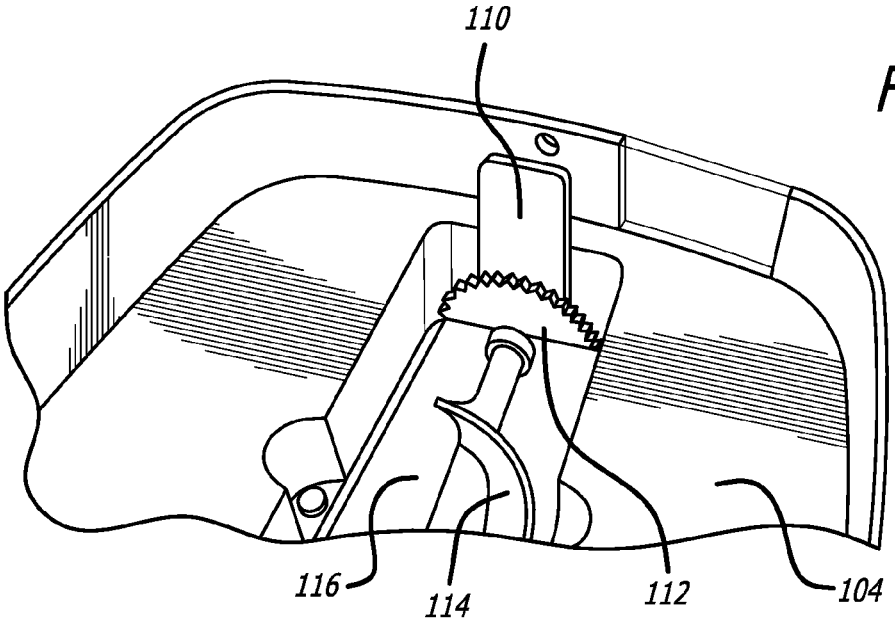
FIG. 3 illustrates the dispensing mechanism inserted into the base of the dispenser of the present invention.

FIG. 3 illustrates the dispensing mechanism 108 inserted into the base 104 of the dispenser 100. As illustrated in FIG. 3, the channel 116 is positioned in a trough in the base 104. The channel 116 may be divided in one or more parts that when assembled creates a pathway from the inside of the container 102 to the exterior of the base 104. In the illustrated example, the channel 116 is in two pieces. The bottom piece or bottom half of the channel 116 is positioned within the trough of the base 104. The advancement mechanism 114, gear 112 and stir stick 110 are then positioned in the trough and channel 116 such that the advancement mechanism 114 is positioned within the channel and the gear 112 and stir stick 110 are positioned adjacent to the channel 106 within the trough.

Figure 4:
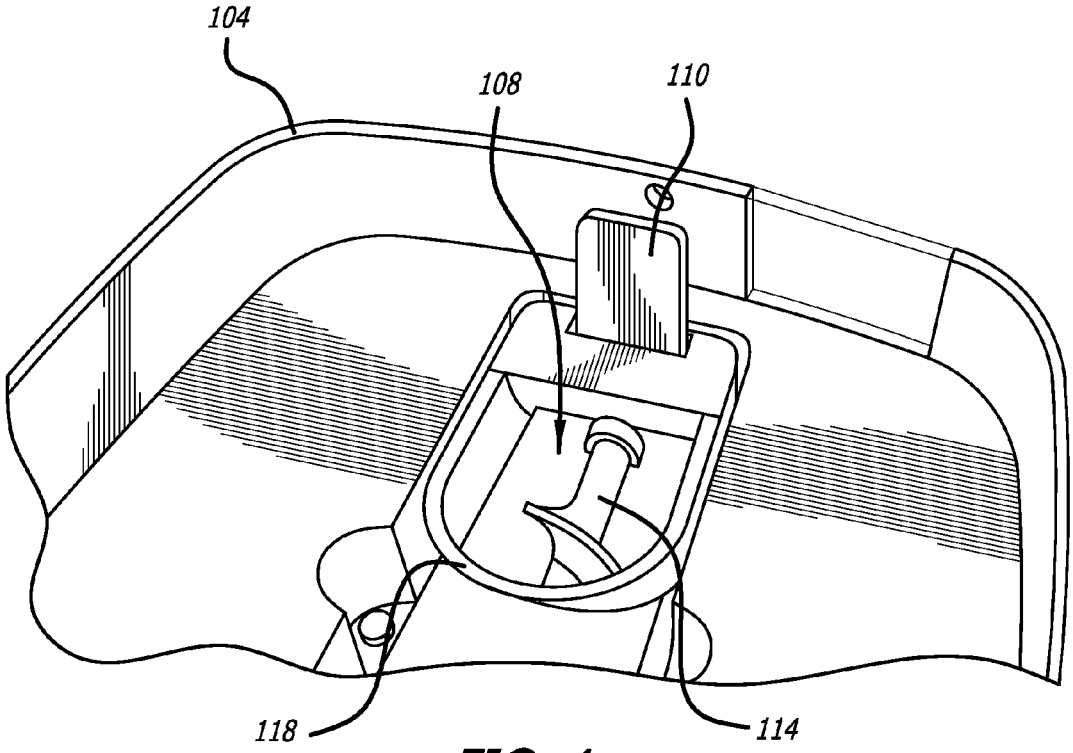
FIG. 4 illustrates the dispensing mechanism and the internal opening for receiving the articles from the container.

FIG. 4 illustrates the dispensing mechanism 108 with the internal opening 118 for receiving the articles from the container 102. As illustrated in FIG. 4, the second half of the channel 116, which includes the interior opening 118, is then mated with the bottom half of the channel 116 to complete the positioning of the dispensing mechanism 108 within the base.

In operation, when the motor is activated, the gear 112 turns; this moves the auger 114. Candy is then moved from the internal opening 118 of the channel 116 to the external opening (not shown) of the channel 116 by the auger 114. The stir stick 110 moves with the gear 112 in a rotating manner above and adjacent to the internal opening 118 to stir the candy being dispensed as it enters the channel 116. The movement of the candy by the stir stick 110 helps to prevent the jamming of the candy as it enters the internal opening 118 of the channel 116.

The foregoing description of various examples of implementations has been presented for purposes of illustration and description. It is not exhaustive and does not limit the claimed inventions to the precise form disclosed. Modifications and variations are possible in light of the above description or may be acquired from practicing the invention. The claims and their equivalents define the scope of the invention.

What is claimed is:

1. A dispenser for dispensing articles, the dispenser comprising:
   - a base and a container, the container is positioned above the base for holding the articles to be dispensed;
   - the base including a channel in communication with the container, the channel having an internal opening near a first end of the channel for receiving the articles held in the container and an external opening near a second end of the channel for dispensing the articles outside of the base;
   - an advancement mechanism located within the channel for moving the articles from the internal opening of the channel to the external opening of the channel;
   - the advancement mechanism being attached to at least one gear for moving the advancement mechanism, where the at least one gear has at least one face;
   - a motor for driving the gear;
   - a stir stick attached to the at least one face of the at least one gear, the stir stick extending upward from the base and into the container at a position adjacent the internal opening of the channel, the stir stick positioned to contact the articles in the container and stir the articles before they enter the internal opening of the channel when the motor is activated.

2. The dispenser of claim 1 where the advancement mechanism is an auger.

3. The dispenser of claim 1 where the motor is motion activated.

4. A base including a dispensing mechanism for use in connection with dispensing articles from a container, the base comprising:
   - a channel having a first opening near one end and a second opening near the opposing end for transporting articles to be dispensed;
   - an advancement mechanism located within the channel for moving the articles through the channel, where the advancement mechanism is an auger;
   - at least one gear attached to the advancement mechanism for moving the advancement mechanism, where the at least one gear has at least one face;
   - a stir stick attached to the at least one face of the at least one gear and extending above the gear for contacting the articles as they enter the internal opening of the channel, the stir stick being positioned near the first opening of the channel, extending upward and perpendicular to the channel, to prevent the jamming of the articles as the articles advance through the channel and dispense from the second opening of the channel.

* * * * *